US006649843B2

(12) United States Patent
Aoyama et al.

(10) Patent No.: US 6,649,843 B2
(45) Date of Patent: Nov. 18, 2003

(54) COMPOSITE CONDUCTOR, PRODUCTION METHOD THEREOF AND CABLE USING THE SAME

(75) Inventors: Seigi Aoyama, Ibaraki (JP); Koichi Tamura, Ibaraki (JP); Takaaki Ichikawa, Ibaraki (JP); Hakaru Matsui, Ibaraki (JP); Osamu Seya, Ibaraki (JP); Fumitaka Nakahigashi, Ibaraki (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/834,724

(22) Filed: Apr. 16, 2001

(65) Prior Publication Data

US 2003/0019661 A1 Jan. 30, 2003

(51) Int. Cl.[7] ..... H01B 5/00

(52) U.S. Cl. ..... 174/126.1; 174/126.2; 174/128.2

(58) Field of Search ..... 174/36, 126.1, 174/126.2, 128.1, 28, 102 R, 106 R

(56) References Cited

U.S. PATENT DOCUMENTS

| | | | | | |
|---|---|---|---|---|---|
| 4,043,028 | A | * | 8/1977 | Koike et al. | 29/599 |
| 4,143,238 | A | * | 3/1979 | Sheth | 174/102 SC |
| 4,301,428 | A | * | 11/1981 | Mayer | 174/36 |
| 4,843,356 | A | * | 6/1989 | Lusignan et al. | 333/236 |
| 4,965,245 | A | * | 10/1990 | Sugimoto et al. | 148/277 |
| 5,091,609 | A | * | 2/1992 | Sawada et al. | 174/110 A |
| 5,371,484 | A | * | 12/1994 | Nixon | 174/108 |
| 5,739,471 | A | * | 4/1998 | Burisch | 174/102 R |
| 5,760,341 | A | * | 6/1998 | Laske et al. | 174/113 R |

FOREIGN PATENT DOCUMENTS

| | | | | |
|---|---|---|---|---|
| JP | 54-72483 A | * | 6/1979 | H01B/5/02 |
| JP | 3-184212 | * | 8/1991 | H01B/5/02 |
| JP | 03-184212 A | * | 8/1991 | H01B/5/08 |
| JP | 06-76640 A | * | 3/1994 | H01B/13/02 |
| JP | 06290639 A | * | 10/1994 | H01B/5/02 |
| JP | 09-011047 | | 1/1997 | B23H/7/08 |
| JP | 10-180546 | | 7/1998 | B23H/7/08 |
| JP | 11-213761 | | 6/1999 | H01B/5/02 |

OTHER PUBLICATIONS

C & M Corporation, Engineering Design Guide (3rd Edition), Jan. 1992, p. 2.*

Surface Handbook, ASM Handbook, vol. 5, pp. 3–4.*

* cited by examiner

*Primary Examiner*—William H. Mayo, III

(74) *Attorney, Agent, or Firm*—Antonelli, Terry, Stout & Kraus, LLP

(57) ABSTRACT

This invention provides a composite conductor having excellent strength, flexing resistance and corrosion resistance, a production method thereof and a cable employing the same composite conductor. A corrosion resistant layer is formed of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—cu alloy, Sn—Cu alloy or Sn—Zn alloy in the thickness of 0.5 $\mu$m or more on an external periphery of a core made of copper-metal fiber conductor. A wire material made of the copper-metal fiber conductor is subjected to area reduction processing. In the middle of the area reduction processing or after the area reduction processing is completed, corrosion resistant layer is formed on the periphery of the wire material in the thickness of 0.5 $\mu$m or more by plating with Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy.

19 Claims, 4 Drawing Sheets

COMPOSITE CONDUCTOR, PRODUCTION METHOD THEREOF AND CABLE USING THE SAME

BACKGROUND OF THE INVENTION

1. Field of the Invention

The present invention relates to a composite conductor, production method thereof and a cable using the same conductor, and more particularly to a composite conductor used for a core wire or inner conductor (simply defined as "core" hereinafter) of a small-diameter coaxial cable and/or an external or outer conductor (simply defined as "external conductor" hereinafter) and a production method thereof.

2. Description of the Related Art

The small-diameter coaxial cable equal to or less than 36 AWG (7-stranded wires) in conductor size is used for medical probe cable, an insertion cable in catheter, LCD harness cable and the like. Conventionally, a stranded conductor of Cu or Cu alloy of 50 μm or less in diameter has been used.

In recent years, demand for multiple cores in case of medical probe cable, demand for reduction of the cable diameter in case of catheter insertion cable and demand for use of a single core in case of the LCD harness cable have been increased. That is, in these cables, cable material having a smaller diameter, excellent strength and flexing characteristic is demanded. Considering reduction of the diameter and economic performance, as the core, the single-wire cable is more favorable than the stranded cable. Therefore, instead of the stranded cable composed of the conventional core of Cu alloy having a short service life against flexings and insufficient strength and conductivity, the single-wire cable composed of alloy material (alloy cable material) having excellent strength and flexing resistance has been demanded.

As the conventional alloy wire material having a high strength, copper-metal fiber conductor in which metal such as Nb, Fe, Ag or the like is diffused in Cumatrix thereof (Cu—Nb base alloy, Cu—Nb—Cr base alloy, Cu—Nb—Zr base alloy, Cu—Ta base alloy, Cu—Fe base alloy, Cu—Ag base alloy, Cu—Cr base alloy) can be mentioned. Of the copper-metal fiber conductors, particularly, Cu—Nb base alloy, Cu—Fe base alloy and Cu—Ag base alloy are known to have excellent conductivity, processability and strength.

Further, as another conventional alloy wire material having a high strength and flexing resistance, the core is formed of Cu—Nb base alloy, Cu—Fe base alloy or Cu—Ag base alloy amoung the copper-metal fiber conductors and an external periphery of the core is coated with metal layer composed of Cu and unavoidable impurity, so that a composite cable having excellent conductivity, processability, strength and flexing resistance is produced (see Japanese Patent Application Laid-Open No. 6-290639).

However, because in the copper-metal fiberconductor, the metal fiber is exposed on the surface of the conductor and two kinds of the metals adjoin each other, if water or electrolyte exists, corrosion is likely to occur due to a difference of contact potential. Therefore, the copper-metal fiber conductor has a problem in corrosion resistance.

In the composite cable, the surface of the copper-metal fiber conductor is coated with Cu coating layer so as to prevent a corrosion by a difference of contact potential between different metals. However, if it is used in the atmosphere with the Cu coating layer as it is, it is discolored because of oxidation. If this discoloration is accelerated, copper oxide film is grown so that corrosion resistance reliability of the composite cable drops. For the reason, in the composite cable, a device for preventing discoloration and oxidation corresponding to the environment has been demanded. Generally, to improve corrosion resistance of the Cu cable, the surface of the Cu cable is coated with benzotriazole or plated with Sn, Ag or the like. However, in case where the composite cable is used for application for a small-diameter coaxial cable or the like, if the thickness of the plating layer is small, the Cu is partially exposed so that corrosion resistance reliability drops.

Further, the alloy wire material for use in the small-diameter coaxial cable is demanded to have not only excellent strength, flexing resistance and corrosion resistance but also excellent connectivity in terms of actual use. Here, of the connectivity, reliability (heat resistance) upon coupling at high temperatures by soldering or the like is an important factor.

Further, the alloy wire material used for these applications is demanded to have as small a diameter as possible and to be easy to produce, namely, processed to a long drawn wire. Therefore, this material is demanded to have an excellent processability (particularly, being drawn excellently).

SUMMARY OF THE INVENTION

Accordingly, the present invention intends to solve the above described problems and provide a composite conductor having excellent strength, flexing resistance and corrosion resistance and production method therefor and a cable using the same composite conductor.

To achieve the above object, according to a first aspect of the present invention, there is provided a composite conductor having a corrosion resistant layer 0.5 μm or more thick constituted of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy on an external periphery of a core of copper-metal fiber conductor.

According to a second aspect of the present invention, there is provided a composite conductor comprised of a metal coating layer of Cu or Cu alloy on an external periphery of a core of copper-metal fiber conductor and a corrosion resistant layer 0.5 μm or more thick constituted of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy on an external periphery of said metal coating layer.

According to a third aspect of the present invention, there is provided a composite conductor according to the first or second aspect wherein the copper-metal fiber conductor is formed of Cu—Nb base alloy, Cu—Ag base alloy or Cu—Fe base alloy.

According to a fourth aspect of the present invention, there is provided a composite conductor according to the third aspect wherein the Cu—Nb base alloy contains Nb of 3–35 mass %.

According to a fifth aspect of the present invention, there is provided a composite conductor according to the third aspect wherein the Cu—Ag base alloy contains Ag of 2–20 mass %.

With the above described structure, the corrosion resistant layer 0.5 μm or more thick composed of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—

Cu alloy, Sn—Cu alloy or Sn—Zn alloy is provided on the external periphery of the cable, thereby ensuring an excellent corrosion resistance.

According to a sixth aspect of the present invention, there is provided a production method for the composite conductor comprising the steps of: applying area reduction processing on a cable of copper-metal fiber conductor; and in the middle of or after the area reduction processing, plating an external periphery of the cable with corrosion resistant layer 0.5 μm or more thick of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy.

According to a seventh aspect of the present invention, there is provided a production method for the composite conductor comprising the steps of: forming a cable of copper-metal fiber conductor having Cu or Cu alloy metal coating layer on an external periphery thereof; applying area reduction processing on the cable; and in the middle of or after the area reduction processing, plating an external periphery of the cable with corrosion resistant layer 0.5 μm or more thick of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy.

According to an eighth aspect of the present invention, there is provided a production method for the composite conductor comprising the steps of: applying area reduction processing on a cable of copper-metal fiber conductor; in the middle of the area reduction processing, forming Cu or Cu alloy metal coating layer on an external periphery of the cable; and after the metal coating layer is formed or the are a reduction processing is completed, plating an external periphery of the cable with corrosion resistant layer 0.5 μm or more thick of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy.

According to a ninth aspect of the present invention, there is provided a production method for the composite conductor comprising the steps of: applying area reduction processing on a cable of copper-metal fiber conductor; after the area reduction processing is completed, forming Cu or Cu alloy metal coating layer on an external periphery of the cable; and after the metal coating layer is formed, plating an external periphery of the cable with corrosion resistant layer 0.5 μm or more thick of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy.

According to a tenth aspect of the present invention, there is provided a production method for the composite conductor according to one of the sixth to ninth aspects wherein the corrosion resistant layer of Au, Sn or solder is formed according to electro-plating method or hot-dip plating method.

According to an eleventh aspect of the present invention, there is provided a production method for the composite conductor according to the sixth-ninth aspect wherein the corrosion resistant layer of Ag or Ni is formed according to electro-plating method.

With the above described methods, the corrosion resistant layer of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy can be formed on the external periphery of the cable without modifying the existing equipment largely.

According to a twelfth aspect of the present invention, there is provided a cable having external conductors disposed around a core, wherein the core or the core and the external conductors are formed of single-wire cables each composed of composite conductor having a corrosion resistant layer 0.5 μm or more thick constituted of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy on an external periphery of a core of copper-metal fiber conductor.

According to a thirteenth aspect of the present invention, there is provided a cable having external conductors disposed around a core, wherein the core or the core and the external conductors are formed of single-wire cables made of composite conductor, each comprised of Cu or Cu alloy metal coating layer formed on an external periphery of the core of copper-metal fiber conductor and a corrosion resistant layer 0.5 μm or more thick constituted of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy formed on an external periphery of the metal coating layer.

With the above described structure, the core or the core and the external conductors are formed of single-wire material of composite conductor. Thus, connectivity such as solderability of soldering cable terminals with each other is excellent.

The reason why the numeric range is limited as described above will be described below.

The reason why the thickness of the corrosion resistant layer is 0.5 μm or more is that if the thickness is less than 0.5 μm, the corrosion resistance of the composite conductor is not sufficient.

The reason why the Nb content of the Cu—Nb base alloy is 3–35 mass % is that if the Nb content is less than 3 mass %, the service life against flexings is inferior and if the Nb content is 35 mass % or more, the wire is likely to be broken when it is drawn.

The reason why the Ag content of Cu—Ag base alloy is 2–20 mass % is that if the Ag content is less than 2 mass %, the service life against flexings is inferior and if the Ag content is 20 mass % or more, the wire is likely to be broken when it is drawn and further it becomes very expensive.

In the meantime, preferably, the diameter of the above described composite conductor is 0.1 mm or less.

DESCRIPTION OF THE PREFERRED EMBODIMENTS

Hereinafter, the preferred embodiments of the present invention will be described in detail with reference to the accompanying drawings.

The inventors of the present invention coated the surface of a copper-metal fiber conductor composing a core with single phase metal or alloy in order to obtain a composite conductor having an excellent corrosion resistance and connectivity. Here, as a composition material for the coated layer, material doing no harm to connecting terminals of composite conductors was selected.

Figure 1:
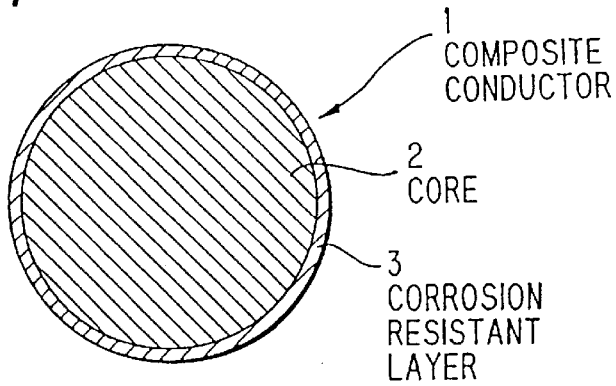
FIG. 1 is a lateral sectional view of a composite conductor according to a first embodiment of the present invention.

FIG. 1 shows a lateral sectional view of a composite conductor according to a first embodiment of the present invention.

As shown in FIG. 1, a composite conductor 1 of the present invention is comprised of a core 2 composed of copper-metal fiber conductor and a corrosion resistant layer 3 on an external periphery of the core 2, composed of Au (Ag, Sn, Ni or solder is permissible) having a thickness of not less than 0.5 $\mu$m.

As the copper-metal fiber conductor composing the core 2, Cu—Nb base alloy, Cu—Ag base alloy and Cu—Fe base alloy can be mentioned. Here, Cu—Nb base alloy containing Nb in 3–35 mass % or Cu—Ag base alloy containing Ag in 2–20 mass % is used as composition material of the core 2.

Although an upper limit of the thickness of the corrosion resistant layer 3 is not restricted to a particular value, it is preferred to be 10 $\mu$m or less from viewpoints of intending to reduce the diameter of the composite conductor 1.

Solder, which is one of composition metal (or alloy) of the corrosion resistant layer 3 is preferred to be free of Pb in order to pay attention to the environment (particularly, environmental aspect for persons engaged in production).

Further, as the composition metal (or alloy) of the corrosion resistant layer 3, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy, Sn—Zn and the like as well as the aforementioned metal (or alloy) can be mentioned.

Further, the corrosion resistant layer 3 is not restricted to a single-layer structure of the aforementioned metal (or alloy) but may be of composite layer structure, for example, two-layer structure in which a Pd plating layer is formed on a Ni foundation layer (or an Ag plating layer is formed on a NiP plating foundation layer) or three-layer structure in which a Pd layer and an Au plating layer are formed on a Ni foundation layer in order.

In the composite conductor 1 of the present invention, the corrosion resistant layer 3 not less than 0.5 $\mu$m thick composed of Au, Ag, Sn, Ni or solder is formed on an external periphery of the core 2 composed of copper-metal fiber conductor. Thus, as compared to the aforementioned conventional composite cable, corrosion resistance can be increased largely while maintaining the same conductivity, processability, strength and flexing resistance.

Au, Ag, Sn, Ni or solder for composing the corrosion resistant layer 3 has no fear of hampering connection when connecting terminals of the composite conductors 1 and has excellent connectivity.

Because the composite conductor 1 of the present invention has a high strength and a high flexing resistance, it can be used as a single-cable material.

Further, because the composite conductor 1 of the present invention has a high strength, a high flexing resistance and an excellent corrosion resistance, it has a high reliability.

Next, production method of the composite conductor 1 of the present invention will be described.

First, as the core 2, wire is formed of copper-metal fiber conductor (for example, Cu-20 mass % Nb) and then, primary area reduction processing is conducted on this wire.

After that, this wire is plated so as to form the corrosion resistant layer 3 of Au (Ag, Sn, Ni or solder) in a predetermined thickness.

Finally, after plating, the wire is subjected to secondary area reduction processing so as to obtain the composite conductor 1 of the present invention. If it is intended to obtain a longer composite conductor 1 than the one obtained in such a manner, the weight (thickness and length) of an initial wire material just should be increased. Consequently, a composite conductor of a necessary length may be obtained.

The primary area reduction processing and secondary area reduction processing are not restricted to particular ones, but include cold drawing processing with draw bench, wire drawing, hot drawing processing and the like.

As a formation method for the corrosion resistant layer 3, electrolytic plating method, electroless plating method, hot-dip coating method and the like can be mentioned. Particularly, if it is intended to form the corrosion resistant layer 3 of Au (Sn or solder), electroplating method or hot-dip coating method is used. If it is intended to form the corrosion resistant layer 3 of Ag (or Ni), the electroplating method is used.

As a method for connecting the terminals of the composite conductors 1, welding with YAG laser or $CO_2$ laser, soldering with laser, soldering with infrared ray or beam, soldering with heat tool and the like can be mentioned.

According to the production method for the composite conductor 1 of the present invention, it is possible to obtain the composite conductor 1 having the corrosion resistant layer 3 whose ultimately outside layer is composed of Au, Ag, Sn, Ni or solder.

According to the production method for the composite conductor of the invention in which the corrosion resistant layer 3 is formed in the middle of the primary area reduction processing and the secondary area reduction processing, productivity of the composite conductor 1 is improved.

In the present invention, a case where the corrosion resistant layer 3 is formed in the middle of the primary area reduction processing and the secondary area reduction processing has been described. The corrosion resistant layer 3 may be formed after the secondary area reduction processing is completed. This method may be applied to the conventional composite cable.

Although, in the present invention, a case where the area reduction processing is composed of two steps has been described, it may be composed of three or more steps.

Next, a composite conductor according to a second embodiment of the present invention will be described.

Figure 2:
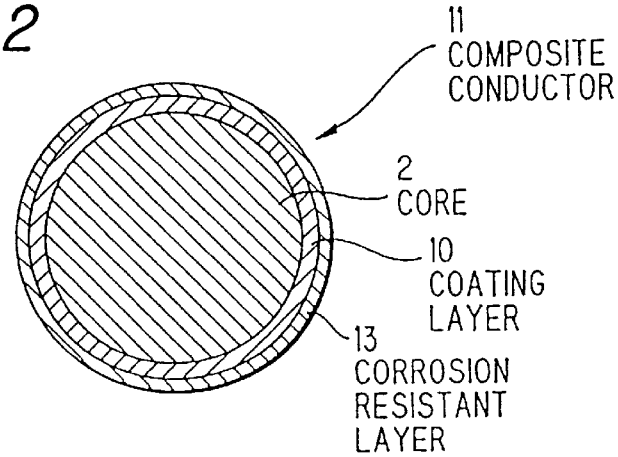
FIG. 2 is a lateral sectional view of a composite conductor according to a second embodiment of the present invention.

FIG. 2 shows a lateral sectional view of the composite conductor according to the second embodiment. Like reference numerals are attached to the same components as FIG. 1.

As shown in FIG. 2, in the composite conductor 11 of this embodiment, coating layer (metal coating layer) 10 is formed of Cu or Cu alloy on an external periphery of the core 2 composed of copper-metal fiber conductor and corrosion resistant layer 13 not less than 0.5 $\mu$m thick is formed of Au (Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy) on the external periphery of that coating layer 10.

Although the thickness of each of the corrosion resistant layer 13 and the coating layer 10 is not restricted to any particular dimension, the total thickness of the corrosion resistant layer 13 and coating layer 10 is preferred to be 10 μm or less from view points for achieving a small diameter of the composite conductor 11. Particularly, thickness of the corrosion resistant layer 13 is preferred to be 1–3 μm and the thickness of the coating layer 10 is preferred to be 2–5 μm.

Because the corrosion resistant layer 13 is formed on the coating layer 10 as shown in FIG. 2 in the composite conductor 11 of this embodiment, the thickness of the corrosion resistant layer 13 can be reduced as compared to the thickness of the corrosion resistant layer 3 shown in FIG. 1. Consequently, as compared to the composite conductor 1 of the present invention, production cost can be reduced.

Next, a production method of the composite conductor 11 shown in FIG. 2 will be described.

First of all, a rod of copper-metal fiber conductor (for example, Cu-20 mass % Nb) is formed. This rod is inserted into a pipe of Cu (or Cu alloy) so as to form a billet. After that, the billet is hot-extruded, so that a cable material having the coating layer 10 of Cu (or Cu alloy) on its external periphery is formed. After that, the cable material is subjected to the primary area reduction processing.

Next, after the primary area reduction processing is completed, the cable material is plated so as to form the corrosion resistant layer 13 of Au (Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy) in a predetermined thickness.

Finally, after plating, the cable material is subjected to the secondary area reduction processing so as to obtain the composite conductor 11 of this embodiment. If it is intended to obtain a longer one than the composite conductor 11 obtained in this way, the weight (thickness and length) of the initial rod just should be increased. Consequently, a composite conductor of a required length can be obtained.

Although in this embodiment, a case where the corrosion resistant layer 13 is formed in the middle of the primary area reduction processing and the secondary area reduction processing, the corrosion resistant layer 13 may be formed after the secondary area reduction processing is terminated.

Next, production method of the composite conductor 11 shown in FIG. 2 will be described.

First of all, the cable material is formed in the same production method as for the composite conductor 1 shown in FIG. 1 and then this cable material is subjected to the primary area reduction processing.

Next, after the primary area reduction processing is completed, the cable material is plated with Cu (or Cu alloy) so as to form the coating layer 10 in a predetermined thickness. After plating with Cu (or Cu alloy), the cable material is subjected to the secondary area reduction processing.

After the secondary area reduction processing is completed, the cable material is plated with Au (Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy) so as to form the corrosion resistant layer 13 in a predetermined thickness. Consequently, the composite conductor 11 of this embodiment is obtained. If it is intended to obtain a longer one than the composite conductor 11 obtained in this way, the weight (thickness and length) of the initial cable material just should be increased. As a result, a composite conductor of a required length is obtained.

Although, according to this embodiment, a case where the coating layer 10 is formed in the middle of the primary area reduction processing and the secondary area reduction processing, the coating layer 10 may be formed after the secondary area reduction processing is completed. Further, although, in this embodiment, a case where the corrosion resistant layer 13 is formed after the secondary area reduction processing is completed has been described, the corrosion resistant layer 13 may be formed prior to the secondary area reduction processing.

It is needless to say that in the above two production methods of the composite conductors 11, the same operation and effect are achieved.

Next, a cable using the composite conductor 1 of the present invention will be described.

Figure 3A:
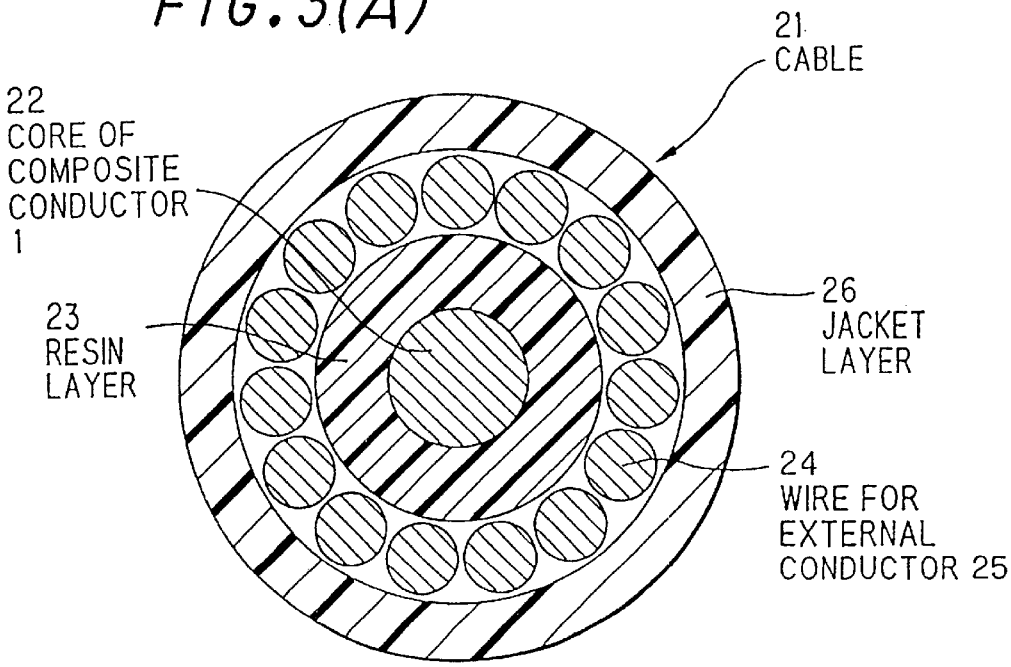
FIG. 3A is a lateral sectional view of a cable using the composite cable of the present invention.

FIG. 3A shows a lateral section of a cable 21 using the composite conductor 1 of the present invention.

In the cable 21 using the composite conductor 1 of the present invention, as shown in FIG. 3A, a single wire of the composite conductor 1 shown in FIG. 1 is employed as a core 22 and a resin layer 23 is formed on an external periphery of that core 22. Then, plural pieces (15 in FIG. 3A) of wires 24 are arranged in the length direction so as to form an external conductor 25. A jacket layer 26 is formed on external periphery of that external conductor 25.

Next, a cable using the composite conductor 22 of the third embodiment will be described with reference to FIG. 3B.

Figure 3B:
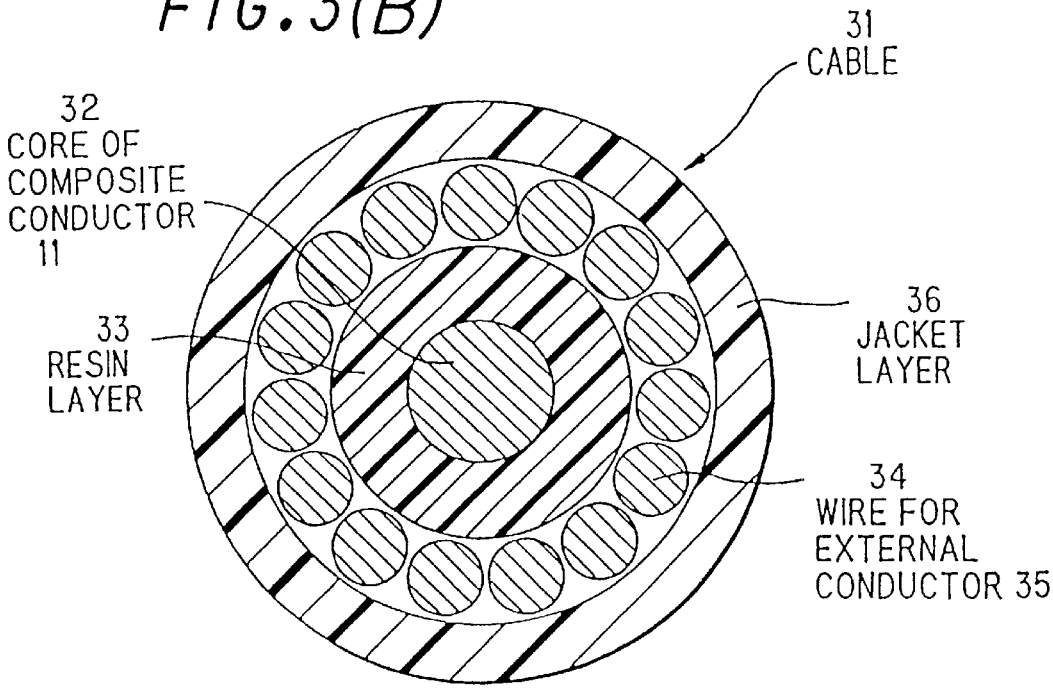
FIG. 3B is a lateral sectional view of a cable using the composite cable according to another embodiment of the present invention.

In the cable 31 using the composite conductor 11 of the third embodiment, as shown in FIG. 3B, a single wire of the composite conductor 11 shown in FIG. 2 is employed as a core 32 and a resin layer 33 is formed on an external periphery of that core 32. Then, plural pieces (15 in FIG. 3B) of cables 34 are arranged in the length direction so as to form an external conductor 35. A jacket layer 36 is formed on an external periphery of that external conductor 35.

Although the diameter of each of the cores 22, 32 is not restricted to any particular size, it is preferred to be 0.04 mm or more, particularly, around 0.06 mm.

As the composition material of the resin layers 23, 33, solid fluororesin can be mentioned. Although the thickness of each of the resin layers 23, 33 is not restricted to any particular size, it is preferred to be 40–80 μm, particularly around 60 μm.

As the composition material for the cable materials 24, 34, Cu alloy (for example, Cu-0.15 mass % Sn alloy) can be mentioned as well as the composite conductors 1, 11 shown in FIGS. 1, 2. Although the diameter of each of the cable materials 24, 34 is not restricted to any particular size, it is preferred to be 0.02–0.06 mm for the composite conductors 1, 11, particularly, around 0.04 mm. For the Cu alloy, the diameter thereof is desired to be 0.01–0.04 mm, particularly around 0.025 mm.

As the composition material for the jacket layers 26, 36, fluororesin, polyethylene terephthalate (hereinafter referred to as PET) and the like can be mentioned. Although the thickness of each of the jacket layers 26, 36 is not restricted to any particular size, for the fluororesin, the thickness is preferred to be 20–60 μm, particularly around 40 μm. For the PET, it is preferred to be 10–40 μm, particularly around 20 μm.

Because in the cables 21, 31, the cores 22, 23 are formed of the composite conductor 1 of the present invention or a single wire of the composite conductor 11, the terminal connectivity of each thereof is excellent without dropping the flex resistance largely as compared to the conventional cable employing the stranded cable.

Further, because each of the cores 22, 32 is a single wire, no stranding step is required, so that the production cost can be reduced and further reliability of the cable can be improved by omitting some production steps.

EXAMPLES OF PRODUCTION

Example 1

A copper-metal fiber conductor rod 32 mm in diameter made of Cu-20 mass % Nb is formed according to vacuum high-frequency melting method using CaO crucible. After forming to 25 mm in diameter by shaving the surface of this rod, it is inserted into a Cu pipe 25 mm in inside diameter and 28 mm in outside diameter so as to form a billet.

After the billet is heated up to 400° C., it is hot extruded according to hydrostatic extrusion method so as to form a composite material 8 mm in diameter. This composite material is subjected to cold extrusion with draw bench and wire drawing so as to form to 0.16 mm in diameter. After that, this cable material is plated with Ag according to electro-plating method so that Ag corrosion resistant layer is formed on an external periphery thereof.

Finally, after plating with Ag, the cable material is subjected to cold drawing processing so as to produce a composite conductor 0.1 mm in diameter having a corrosion resistant layer 1 $\mu$m thick.

Comparative Example 1

A composite material is formed in the same manner as the example land this composite material is subjected to cold drawing processing with draw bench and wire drawing, so as to produce a wire 0.1 mm in diameter.

The composite conductor of the example 1 and the wire of the comparative example 1 were evaluated in terms of strength, flex resistance, corrosion resistance and connectivity.

Here, the flex resistance was evaluated with the number of flexings to break (service life against flexing) in case when flexing test with bending distortion of 1% was carried out.

Figures 4A, 4B, 4C:
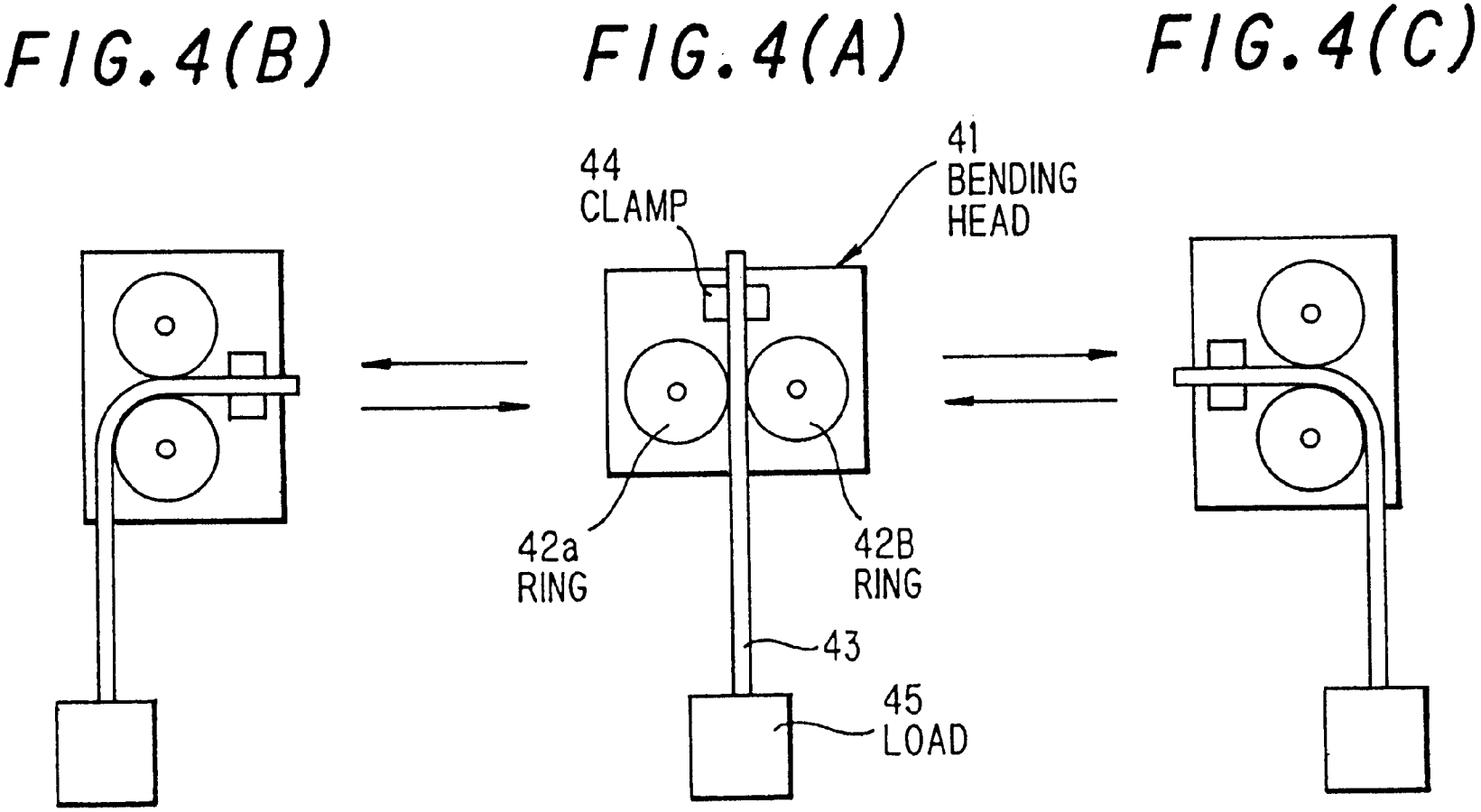
FIGS. 4(a–c) is a schematic view of a bending head for use in bending test.

As shown in FIG. 4(*a*), a bending head 41 for flexing test comprises a pair of rings 42*a*, 42*b* and a clamp 44. A composite conductor (or wire) 43 of a predetermined length is nipped between these rings 42*a* and 42*b*. An end of the composite conductor 43 is fixed with the clamp 44 while a load 45 of a predetermined weight is fixed to the other end thereof. The bending head 41 is rotated by 90° to the right or the left around a nipping point with a driving means (not shown).

For the flexing test, the bending head 41 is rotated by 90° to the right from a condition shown in FIG. 4(*a*) to a condition shown in FIG. 4(*b*). After a bending in a predetermined direction (rightward in FIG. 4) is applied to the composite conductor 43, the bending head 41 is rotated by 90° to the left to return to the condition shown in FIG. 4(*a*), thereby completing the flexing step for the predetermined direction. After that, the bending head 41 is rotated by 90° to the left from the condition shown in FIG. 4(*a*) to a condition shown in FIG. 4(*c*). After a bending in the other direction (leftward in FIG. 4) is applied to the composite conductor 43, the bending head 41 is rotated by 90° to the right to return to the condition shown in FIG. 4(*a*), thereby completing the flexing step for the other direction. If this flexing step is repeated alternately, the composite conductor 43 is broken at some point of time. The number of flexings up to this breaking is considered to be the service life against flexings.

In the composite conductor of the example 1, its conductivity was 50% IACS, which was in available range and its tensile strength was 1,350 MPa and its service life against flexings was 28,500. Thus, this composite conductor had excellent strength and flexing resistance.

Figure 5:
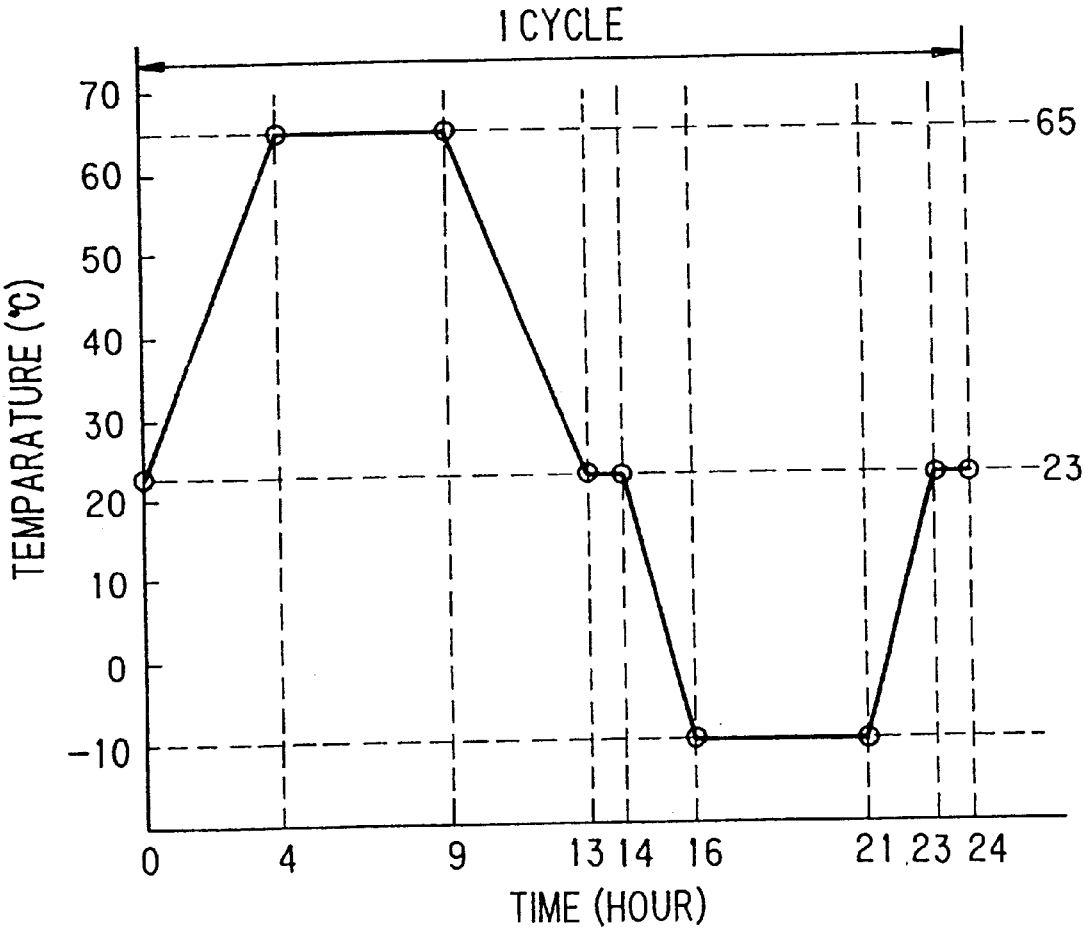
FIG. 5 is a profile of temperature history in corrosion resistance test.

FIG. 5 shows a profile of temperature history in corrosion resistance test.

As shown in FIG. 5, the temperature was raised from 23° to 65° in four hours and maintained for five hours. After that, the temperature was dropped from 65° to 23° in four hours and maintained for an hour. After that, the temperature was dropped from 23° to −10° in two hours and maintained for five hours. After that, the temperature was raised from −10° to 23° in two hours and maintained for an hour. The above steps constitute a cycle of temperature history. Corrosion resistance test was carried out on a composite conductor under the atmosphere of 90% in humidity by 10 cycles. After that, changes of color in the composite conductor and cable after the corrosion resistance test were evaluated.

As a result, the surface of the cable of the comparative example 1 was discolored remarkably because it had no corrosion resistant layer. However, no discoloration was observed in the composite conductor of the example 1 having Ag corrosion resistant layer.

For evaluation of connectivity, solderability was tested. As the solder, a solder free of Pb with Sn 100% was used and as a soldering method, soldering with beam was used.

As a result, the composite conductor of the example 1 was not lack of wettability at the time of soldering. Further, because the composite conductor of the example 1 was a single wire, no soldering bridge was generated when soldering was carried out with a narrow pitch. That is, the composite conductor of the example 1 had an excellent connectivity.

Therefore, the composite conductor of the example 1, which was the composite conductor of the present invention, had both excellent flexing resistance and corrosion resistance, and excellent reliability and connectivity.

Example 2-1

First, a rod of copper-metal fiber conductor containing Cu-5 mass % Nb was prepared like the example 1. After that, it was hot extruded according to hydrostatic extrusion method.

Next, after hot-extrusion, a cable 8 mm in diameter was subjected to cold drawing processing so as to form a cable 0.1 mm in diameter. After that, this cable was plated with Sn under electro-plating method, so as to produce a composite conductor having Sn corrosion resistant layer 1 $\mu$m thick on its external periphery.

Example 2-2

A composite conductor was prepared in the same way as the example 2-1 except that a rod made of copper-metal fiber conductor containing Cu-15 mass % Nb was used.

Example 2-3

A composite conductor was prepared in the same way as the example 2-1 except that a rod made of copper-metal fiber conductor containing Cu-20 mass % Nb was used.

Example 2-4

A composite conductor was prepared in the same way as the example 2-1 except that a rod made of copper-metal fiber conductor containing Cu-25 mass % Nb was used.

Example 3

The composite conductor was produced in the same manner as the example 2-1 except that a rod made of copper-metal fiber conductor containing Cu-20 mass % Nb was used and the Ag corrosion resistant layer 1 μm thick was formed on the external periphery of the cable.

Example 4

The composite conductor was produced in the same manner as the example 2-1 except that a rod made of copper-metal fiber conductor containing Cu-20 mass % Nb was used and the Ni corrosion resistant layer 1 μm thick was formed on the external periphery of the cable.

Example 5-1

First, a rod made of copper-metal fiber conductor containing Cu-10 mass % Nb was prepared. After this rod was inserted into a Cu pipe, the billet was heated and was hot extruded according to hydrostatic extrusion method so as to form a composite wire material.

Next, the composite wire material was subjected to cold drawing processing, so that a wire 0.1 mm in diameter having Cu coating layer 2 μm thick on an external periphery thereof was formed. After that, this wire material was plated with Sn according to electro-plating method, so as to produce a composite conductor having Sn corrosion resistant layer 1 μm thick on the external periphery.

Example 5-2

A composite conductor was produced in the same manner as the example 5-1 except that a rod made of copper-metal fiber conductor containing Cu-20 mass % Nb was used.

Example 5-3

A composite conductor was produced in the same manner as the example 5-1 except that a rod made of copper-metal fiber conductor containing Cu-35 mass % Nb was used.

Example 6

A composite conductor was produced in the same manner as the example 5-1 except that a rod made of copper-metal fiber conductor containing Cu-20 mass % Nb was used and the Ag corrosion resistant layer 1 μm thick was formed on the external periphery of the cable.

Example 7

A composite conductor was produced in the same manner as the example 5-1 except that a rod made of copper-metal fiber conductor containing Cu-20 mass % Nb was used and the Ni corrosion resistant layer 1 μm thick was formed on the external periphery of the cable.

Example 8

A composite conductor was produced in the same manner as the example 5-1 except that a rod made of copper-metal fiber conductor containing Cu-20 mass % Nb was used and the Au corrosion resistant layer 0.5 μm thick was formed on the external periphery of the cable.

Example 9

First, a rod made of copper-metal fiber conductor containing Cu-20 mass % Nb was prepared. After this rod was inserted into a Cu-35 mass % Zn pipe, the billet was heated and was hot extruded according to hydrostatic extrusion method so as to form a composite wire material.

Next, the composite wire material was subjected to cold drawing processing, so that a wire 0.1 mm in diameter having Cu—Zn coating layer 2 μm thick on an external periphery thereof was formed. After that, this wire material was plated with Sn according to electro-plating method, so as to produce a composite conductor having Sn corrosion resistant layer 1 μm thick on the external periphery.

Example 10-1

First, a copper-metal fiber conductor rough drawing wire 10 mm in diameter and composed of Cu-2 mass % Ag was formed by casting with a vertical vacuum fusion apparatus.

Primary heating processing was applied to this rough drawing wire at processing degree of 35% under 450° C. for 1.5 hours. After that, this wire material was subjected to secondary heating processing at processing degree of 65% under 450° C. for 1.5 hours. After that, this wire material was subjected to tertiary heating processing at processing degree of 90% under 350° C. for 1.5 hours.

Next, this wire material was subjected to cold drawing processing, so that a wire 0.1 mm in diameter was formed. After that, this wire material was plated with Cu according to electro-plating method, so that Cu coating layer 2 μm thick was formed on the external periphery of the cable.

Finally, this wire material was plated with Sn according to electro-plating method, so that a composite conductor having Sn corrosion resistant layer 1 μm on the external periphery was produced.

Example 10-2

A composite conductor was produced in the same manner as example 10-1 except that a copper-metal fiber rough drawing wire containing Cu-10 mass % Ag was used.

Example 10-3

A composite conductor was produced in the same manner as example 10-1 except that a copper-metal fiber rough drawing wire containing Cu-20 mass % Ag was used.

Example 11-1

A composite conductor was produced in the same manner as example 10-1 except that the wire material was plated with Ag so as to form Ag corrosion resistant layer 1 μm thick on the external periphery.

Example 11-2

A composite conductor was produced in the same manner as example 10-2 except that the wire material was plated with Ag so as to form Ag corrosion resistant layer 1 μm thick on the external periphery.

Example 11-3

A composite conductor was produced in the same manner as example 10-3 except that the wire material was plated with Ag so as to form Ag corrosion resistant layer 1 μm thick on the external periphery.

Example 12-1

A composite conductor was produced in the same manner as example 10-1 except that the wire material was plated with Ni so as to form Ni corrosion resistant layer 1 μm thick on the external periphery.

Example 12-2

A composite conductor was produced in the same manner as example 10-2 except that the wire material was plated with Ni so as to form Ni corrosion resistant layer 1 μm thick on the external periphery.

Example 12-3

A composite conductor was produced in the same manner as example 10-3 except that the wire material was plated with Ni so as to form Ni corrosion resistant layer 1 μm thick on the external periphery.

Comparative Example 2

First, a rod made of copper-metal fiber conductor containing Cu-20 mass % Nb was prepared. After this rod was inserted into a Cu pipe, the billet was heated and was hot extruded according to hydrostatic extrusion method so as to form a composite wire material.

Next, the composite wire material was subjected to cold drawing processing, so that a wire 0.1 mm in diameter having Cu coating layer 2 μm thick on an external periphery thereof was formed.

Comparative Example 3

A wire material 0.1 mm in diameter made of tough pitch copper (hereinafter referred to as TPC) was prepared.

Table 1 shows characteristics of composite conductors of the examples 2–12 and wire materials of the comparative examples 2, 3 (chemical composition, corrosion resistant layer of the core (or chemical composition, metal coating layer and corrosion resistant layer of the core).

TABLE 1

| | characteristics | | |
|---|---|---|---|
| example | chemical composition of core | corrosion resistant layer or metal coating layer (μm) | corrosion resistant layer (μm) |
| example | | | |
| 2-1 | Cu-5 mass % Nb | Sn (1) | — |
| 2-2 | Cu-15 mass % Nb | Sn (1) | — |

TABLE 1-continued

| | characteristics | | |
|---|---|---|---|
| example | chemical composition of core | corrosion resistant layer or metal coating layer (μm) | corrosion resistant layer (μm) |
| 2-3 | Cu-20 mass % Nb | Sn (1) | — |
| 2-4 | Cu-25 mass % Nb | Sn (1) | — |
| 3 | Cu-20 mass % Nb | Ag (1) | — |
| 4 | Cu-20 mass % Nb | Ni (1) | — |
| 5-1 | Cu-10 mass % Nb | Cu (2) | Sn (1) |
| 5-2 | Cu-20 mass % Nb | Cu (2) | Sn (1) |
| 5-3 | Cu-35 mass % Nb | Cu (2) | Sn (1) |
| 6 | Cu-20 mass % Nb | Cu (2) | Ag (1) |
| 7 | Cu-20 mass % Nb | Cu (2) | Ni (1) |
| 8 | Cu-20 mass % Nb | Cu (2) | Au (1.5) |
| 9 | Cu-20 mass % Nb | Cu-35 mass % Zn (2) | Sn (1) |
| 10-1 | Cu-2 mass % Ag | Cu (2) | Sn (1) |
| 10-2 | Cu-10 mass % Ag | Cu (2) | Sn (1) |
| 10-3 | Cu-20 mass % Ag | Cu (2) | Ag (1) |
| 11-1 | Cu-2 mass % Ag | Cu (2) | Ag (1) |
| 11-2 | Cu10 mass % Ag | Cu (2) | Ag (1) |
| 11-3 | Cu-20 mass % Ag | Cu (2) | Ni (1) |
| 12-1 | Cu-2 mass % Ag | Cu (2) | Ni (1) |
| 12-2 | Cu10 mass % Ag | Cu (2) | Ni (1) |
| 12-3 | Cu-20 mass % Nb | Cu (2) | Ni (1) |
| Comparative example | | | |
| 2 | Cu-20 mass % Nb | Cu (2) | — |
| 3 | CU (TPC) | — | — |

Next, Table 2 shows characteristics of the composite conductors the examples 2–12 and wire materials of the comparative examples 2, 3 (tensile strength (MPa), service life against flexings (times), corrosion resistance, connectivity, and total evaluation). Here, the flexing resistance was evaluated in the same manner as the example 1 and half 7 times the service life against flexings of the wire material of the comparative example 2 ((1,000×7)÷2=3,500 (times)). Further, the corrosion resistance and connectivity were evaluated in the same manner as the example 1. An acceptable result was expressed with a circle and an unacceptable result was expressed with a cross. Further, in the total evaluation, excellent and acceptable results were expressed with a circle and an unacceptable result was expressed with a x.

TABLE 2

| | Characteristic | | | | | |
|---|---|---|---|---|---|---|
| | tensile strength | service life against flexings | | corrosion | | total |
| example | (Mpa) | (number) | evaluation | resistance | connectivity | evaluation |
| example | | | | | | |
| 2-1 | 1,000 | 9,000 | ○ | ○ | ○ | ○ |
| 2-2 | 1,250 | 15,000 | ○ | ○ | ○ | ○ |
| 2-3 | 1,320 | 17,500 | ○ | ○ | ○ | ○ |
| 2-4 | 1,410 | 29,000 | ○ | ○ | ○ | ○ |
| 3 | 1,310 | 17,900 | ○ | ○ | ○ | ○ |
| 4 | 1,330 | 18,200 | ○ | ○ | ○ | ○ |
| 5-1 | 1,170 | 12,000 | ○ | ○ | ○ | ○ |
| 5-2 | 1,315 | 18,000 | ○ | ○ | ○ | ○ |
| 5-3 | 1,450 | 30,000 | ○ | ○ | ○ | ○ |
| 6 | 1,300 | 17,910 | ○ | ○ | ○ | ○ |
| 7 | 1,320 | 18,100 | ○ | ○ | ○ | ○ |
| 8 | 1,320 | 17,900 | ○ | ○ | ○ | ○ |

TABLE 2-continued

| | Characteristic | | | | | |
|---|---|---|---|---|---|---|
| | tensile strength | service life against flexings | | corrosion | | total |
| example | (Mpa) | (number) | evaluation | resistance | connectivity | evaluation |
| 9 | 1,370 | 29,000 | ○ | ○ | ○ | ○ |
| 10-1 | 900 | 4,900 | ○ | ○ | ○ | ○ |
| 10-2 | 980 | 6,000 | ○ | ○ | ○ | ○ |
| 10-3 | 1,140 | 11,000 | ○ | ○ | ○ | ○ |
| 11-1 | 890 | 4,850 | ○ | ○ | ○ | ○ |
| 11-2 | 970 | 5,900 | ○ | ○ | ○ | ○ |
| 11-3 | 1,100 | 9,900 | ○ | ○ | ○ | ○ |
| 12-1 | 960 | 5,800 | ○ | ○ | ○ | ○ |
| 12-2 | 990 | 7,000 | ○ | ○ | ○ | ○ |
| 12-3 | 1,180 | 11,900 | ○ | ○ | ○ | ○ |
| Comparative example | | | | | | |
| 2 | 1,320 | 17,900 | ○ | X | ○ | X |
| 3 | 580 | 1,000 | X | X | ○ | X |

As evident from Table 2, as regards the composite conductors of the examples 2–12 according to the present invention, the tensile strength was high (890–1,450 MPa), the service life against flexings was acceptable (4850–30,000 times) and the corrosion resistance and connectivity were excellent in every case. The total evaluations were excellent.

As regards the composite conductors of the examples 2–12 according to the present invention, conductivity was 50% IACS or more in every case. There was no case having a particularly low conductivity, so that any one could be applied to the cable.

On the other hand, in case of the wire material of the comparative example 2, the tensile strength was as high as 1,320 MPa and the service life against flexings was as long as 17,900 times and the connectivity was also excellent. However, the surface of the Cu coating layer was oxidized violently because it was formed on the external periphery of the cable. That is, in this case, the corrosion resistance was inferior and the total evaluation was also inferior.

In case of the wire material of the comparative example 3, the connectivity was excellent, but the tensile strength was as low as 580 MPa because it was composed of a single TPC and the service life against flexings was as short as 1,000 times. Further, the surface was oxidized violently. That is, the tensile strength, flexing resistance and corrosion resistance were not excellent and the total evaluation was not excellent either.

The composite conductor of the present invention can be applied to a conductor for a signal transmitting/receiving cable and the like in signal transmitting/receiving system of transmission field such as personal computer internal wiring, medical signal line, and mobile communication.

Further, the cable employing the composite conductor of the present invention can be applied to multi-core cable and the like for obtaining high precision image like an ultrasonic diagnostic probe cable.

The embodiments of the present invention are not restricted to the above described ones, but it is needless to say that the present invention may be modified in other various ways.

As described above, the following effects are achieved by the present invention.

(1) By forming the corrosion resistant layer 0.5 μm or more thick of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy, or Sn—Zn alloy on the external periphery of the core, the corrosion resistance can be improved largely as compared to the conventional composite wire.

(2) The composite conductor having the corrosion resistant layer of (1) on the external periphery of the cable can be produced without modifying the existing equipment largely.

What is claimed is:

1. A composite conductor, comprising:

a copper-metal fiber core conductor;

a metal coating layer formed on the outer periphery of said copper-metal fiber core conductor, said metal coating layer being of Cu or Cu alloy; and a corrosion resistant layer formed on the outer periphery of said metal coating layer, said corrosive resistant layer being of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy, and said corrosion resistant layer having a thickness of 0.5 to 3 μm;

wherein the ratio of the thickness of said metal coating layer and the diameter of said composite conductor is in the range of 2/100 to 5/100.

2. A composite conductor according to claim 1, wherein:

said copper-metal fiber core conductor is formed of Cu—Nb base alloy, Cu—Ag base alloy or Cu—Fe base alloy.

3. A composite conductor according to claim 2, wherein:

said Cu—Nb base alloy contains Nb of 3–35 mass %.

4. A composite conductor according to claim 2, wherein:

said Cu—Ag base alloy contains Ag of 2–20 mass %.

5. A composite conductor, comprising:

a copper-metal fiber core conductor;

a metal coating layer formed on the outer periphery of said copper metal-fiber core conductor; and a corrosion resistant layer on the outer periphery of said metal coating layer;

wherein the ratio of the thickness of said metal coating layer and the diameter of said composite conductor is in the range of 2/100 to 5/100.

6. A composite conductor according to claim 5, wherein:

said metal coating layer has a thickness of 1.0 to 5.0 μm; and said corrosion resistant layer has a thickness of 0.5 to 3.0 μm.

7. A composite conductor according to claim 6, wherein:

said corrosion resistant layer is a metal corrosive resistant layer, and said composite conductor has a diameter of 0.02 mm to 0.06 mm.

8. A composite conductor according to claim 5, wherein:

said corrosion resistant layer includes one of Au, Ag, Sn, Ni, solder, Zn, and Pd.

9. A composite conductor according to claim 5, wherein:

said corrosion resistant layer includes an alloy having at least one of Ag, Sn, Ni, and Zn.

10. A composite conductor according to claim 5, wherein:

said corrosion resistant layer excludes Au, Ag, Sn, and Ni.

11. A composite conductor according to claim 5, wherein:

said corrosion resistant layer includes solder, Zn, Pd and an alloy having Zn.

12. A composite conductor according to claim 5, wherein:

said core conductor includes a base alloy having one of Cu—Nb, Cu—Ag, and Cu—Fe.

13. A composite conductor according to claim 5, wherein:

said core conductor includes a Cu—Nb base alloy having 3–35 mass % of Nb.

14. A composite conductor according to claim 5, wherein:

said core conductor includes a Cu—Ag base alloy having 2–20 mass % of Ag.

15. A composite conductor according to claim 5, wherein said composite conductor is a cable core conductor, and further comprising:

a plurality of external cable conductors disposed around the cable core conductor.

16. A composite conductor according to claim 15, wherein each of said plurality of external cable conductors includes:

another copper-metal fiber core conductor;

another metal coating layer formed on the outer periphery of said other copper-metal fiber core conductor, said other metal coating layer being of Cu or Cu alloy; and another corrosion resistant layer formed on the outer periphery of said other metal coating layer.

17. A composite conductor according to claim 16, wherein:

each other metal coating layer has a thickness of 2.0 to 5.0 μm; and each other corrosion resistant layer has a thickness of 0.5 to 3.0 μm.

18. A composite conductor according to claim 15, further comprising:

a resin layer disposed between said cable core conductor and said plurality of external cable conductors; and a jacket layer covering said cable core conductor, said resin layer and said plurality of external cable conductors.

19. A cable comprising:

a core; and external conductors disposed around said core, said core, or said core and said external conductors, being formed of single-wire of composite conductor;

wherein said core or said core and said external conductors comprises:

a copper-metal fiber core conductor;

a metal coating layer formed on the outer periphery of said copper-metal fiber core conductor, said metal coating layer being of Cu or Cu alloy; and a corrosion resistant layer formed on the outer periphery of said metal coating layer, said corrosion resistant layer being of Au, Ag, Sn, Ni, solder, Zn, Pd, Sn—Ni alloy, Ni—Co alloy, Ni—P alloy, Ni—Co—P alloy, Cu—Zn alloy, Sn—Bi alloy, Sn—Ag—Cu alloy, Sn—Cu alloy or Sn—Zn alloy, and said corrosion resistant layer having a thickness of 0.5 to 3 μm;

wherein the ratio of the thickness of said metal coating layer and the diameter of said composite conductor is in the range of 2/100 to 5/100.

* * * * *